US008408319B2

(12) United States Patent
Chen et al.

(10) Patent No.: US 8,408,319 B2
(45) Date of Patent: Apr. 2, 2013

(54) CONTROL SWELLING OF SWELLABLE PACKER BY PRE-STRAINING THE SWELLABLE PACKER ELEMENT

(75) Inventors: Kuo-Chiang Chen, Sugar Land, TX (US); John Whitsitt, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 438 days.

(21) Appl. No.: 12/643,597

(22) Filed: Dec. 21, 2009

(65) Prior Publication Data

US 2011/0147014 A1 Jun. 23, 2011

(51) Int. Cl.
*E21B 33/12* (2006.01)
*E21B 23/00* (2006.01)

(52) U.S. Cl. ..... 166/387; 166/120; 166/179; 166/180

(58) Field of Classification Search ..... 166/387, 166/120, 179, 187, 180
See application file for complete search history.

(56) References Cited

U.S. PATENT DOCUMENTS

| | | | | |
|---|---|---|---|---|
| 3,298,441 | A * | 1/1967 | Young | 166/179 |
| 3,316,969 | A * | 5/1967 | Smith | 166/387 |
| 3,661,207 | A * | 5/1972 | Current et al. | 166/120 |
| 3,941,190 | A * | 3/1976 | Conover | 166/187 |
| 4,577,696 | A * | 3/1986 | Suman | 166/387 |
| 4,665,992 | A * | 5/1987 | Franc | 166/387 |
| 4,744,421 | A * | 5/1988 | Wood et al. | 166/387 |
| 7,387,158 | B2 | 6/2008 | Murray | |
| 7,392,841 | B2 | 7/2008 | Murray | |
| 7,543,640 | B2 | 6/2009 | MacDougall | |
| 7,562,704 | B2 | 7/2009 | Wood | |
| 7,637,320 | B2 | 12/2009 | Howard | |
| 7,665,537 | B2 | 2/2010 | Patel | |
| 2003/0192687 | A1 * | 10/2003 | Goodson et al. | 166/65.1 |
| 2005/0199401 | A1 * | 9/2005 | Patel et al. | 166/387 |
| 2007/0144733 | A1 | 6/2007 | Murray | |
| 2009/0038796 | A1 * | 2/2009 | King | 166/277 |
| 2009/0139707 | A1 | 6/2009 | Berzin | |
| 2009/0139710 | A1 | 6/2009 | Robisson | |
| 2009/0229816 | A1 | 9/2009 | Lemme | |
| 2009/0255692 | A1 * | 10/2009 | Coronado | 166/387 |

* cited by examiner

*Primary Examiner* — Daniel P Stephenson
*Assistant Examiner* — Michael Wills, III
(74) *Attorney, Agent, or Firm* — Rodney Warfford; Tim Curington

(57) ABSTRACT

A swellable packer including a first retainer, a second retainer, a swellable element, a piston, and a piston lock. The second retainer is spaced axially apart from the first retainer. The swellable element is at least partially disposed between and fixed to the first and second retainers. The piston is fixed to the second retainer and configured to move the second retainer from a first position in which the swellable element is unstrained, to a second position in which the swellable element is strained. The piston lock is configured to releasably fix the second retainer in the second position.

15 Claims, 7 Drawing Sheets

CONTROL SWELLING OF SWELLABLE PACKER BY PRE-STRAINING THE SWELLABLE PACKER ELEMENT

BACKGROUND

One or more hydrocarbon bearing zones within a wellbore often need to be isolated from other portions of the wellbore. An effective solution for zonal isolation is the use of swellable packers. However, controlling the swelling rate of the swellable material that forms the sealing element of the swellable packer is important. If the swell rate of the swellable material is too slow, the setting of a completion within the wellbore will take too long, which unnecessarily increases costs, including rig time and personnel. If the swell rate of the swellable material is too rapid, the swellable packer can set the completion within the wellbore before the completion is properly located within the wellbore.

Furthermore, swellable materials with faster swelling rates often have a higher final swell percentage, and materials with slower swelling rates often have a smaller final swell percentage. Accordingly, if a large final swell percentage is desired, the swell rate of the swellable material may make it impossible to completely run the completion into the wellbore. One method of controlling swelling rates of swellable materials is to encapsulate the swellable material in a material having a slower swell rate, which prevents the fluid from reaching the swellable material until the slower swell rate material is either dissolved or saturated. This method is problematic because the material with the slower swell rate can be damaged while being run into the wellbore, and the fluid can reach the faster swell rate material faster than expected. As such, the faster swell rate material can start swelling sooner than expected, and the completion can be prematurely secured within the wellbore.

A need exists, therefore, for apparatus and methods that can predictably retard the swell rate of a high swell percentage material for a predetermined time and allow for the swellable element to reach the full swell percentage of the swellable material after a predetermined time.

SUMMARY

Embodiments of the disclosure may provide an exemplary method of controlling the swell rate of a swellable element. The exemplary method may include straining the swellable element disposed on a tubular member between a first retainer and a second retainer, the swellable element attached to the first and second retainers, straining the swellable element comprising moving the second retainer from a first position to a second position away from the first position. The exemplary method may also include securing the second retainer in the second position with an actuation device, and actuating a trigger mechanism to cause the actuation device to release the second retainer from the second position.

Embodiments of the disclosure may also provide an exemplary swellable packer including a tubular member, a first retainer, a second retainer, a swellable element, an actuation device, and a trigger mechanism. The first retainer is fixed to the tubular member. The second retainer is disposed on the tubular member, is spaced axially apart from the first retainer, and is axially movable between a first position and a second position. The swellable element is disposed on the tubular member between the first retainer and the second retainer, and fixed to the first and second retainers. The actuation device is connected to the second retainer and configured to releasably secure the second retainer in the second position. The trigger mechanism is connected to the actuation device and configured to release the second retainer from the second position when the trigger mechanism is triggered.

Embodiments of the disclosure may further provide an exemplary swellable packer including a first retainer, a second retainer, a swellable element, a piston, and a piston lock. The second retainer is spaced axially apart from the first retainer. The swellable element is at least partially disposed between the first and second retainer and fixed to the first and second retainers. The piston is fixed to the second retainer and is configured to move the second retainer from a first position in which the swellable element is unstrained, to a second position in which the swellable element is strained. The piston lock is configured to releasably fix the second retainer in the second position.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1:
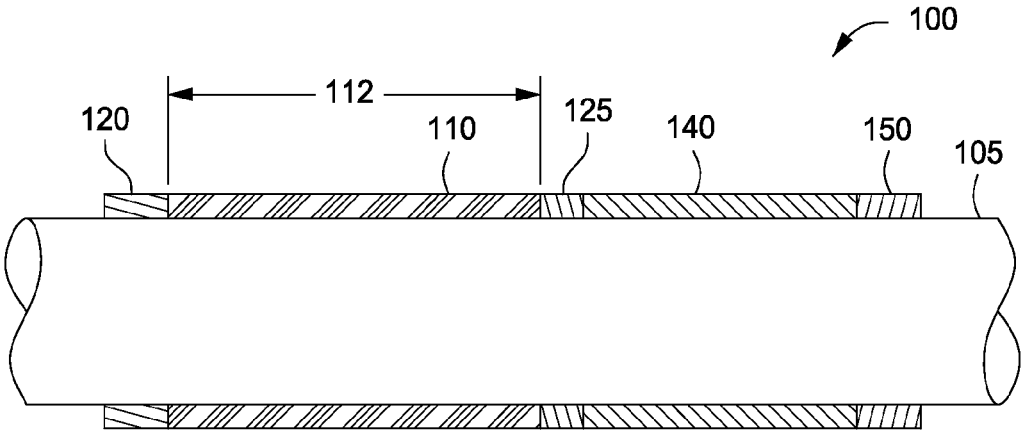
FIG. 1 depicts a cross-sectional view of an exemplary swellable packer, according to one or more embodiments described.

FIG. 1 depicts a cross-sectional view of an illustrative swellable packer 100, according to one or more embodiments. The swellable packer 100 can include a tubular member 105 having first and second retainers 120, 125, an actuation device 140, and a swellable element 110, which can be made of one or more materials capable of absorbing and/or otherwise reacting with fluid in a wellbore to increase in volume, as known in the art. The swellable packer 100 can also include a trigger mechanism 150 disposed about the tubular member 105. It will be appreciated that additional retainers, swellable elements, and trigger mechanisms may be included without departing from the scope of this disclosure.

The tubular member 105 can be a downhole tubular such as blank pipe. The tubular member 105 can be configured to connect to one or more other downhole tubular members (not shown). Accordingly, the tubular member 105 can be incorporated into a completion string, a workstring, or another downhole string, tool, or component.

The retainers 120, 125 can be connected with the swellable element 110. The first retainer 120, which can also be referred to as the upper retainer 120, can be fixed on the tubular member 105, for example, circumferentially around the outside of the tubular member 105. In various exemplary embodiments, the first retainer 120 can be a ring or wedge welded, fastened, or otherwise fixed to the tubular member 105. In one or more embodiments, the retainer 120 can be fixed to the tubular member 105 by suitable mechanical fasteners, such as bolts, soldering, clips, or similar devices. The second retainer 125, which can also be referred to as the lower retainer 125, can similarly be a ring or wedge connected or attached to the actuation device 140. The second retainer 125 can be movably disposed on the tubular member 105. For example, the second retainer 125 can slide axially along the outer circumference of the tubular member 105. In an exemplary embodiment, the second retainer 125 can move on the tubular member 105, for example, axially from a first position (shown in FIG. 2A) to a second position (shown in FIG. 2B), as described below.

The swellable element 110 can be disposed between the first and second retainers 120, 125 and attached to each. Further, the swellable element 110 can have an original or first length 112 when the second retainer 125 is in the first position and a strained or second length (shown in, and described in more detail below with reference to, FIG. 7) when the second retainer 125 is in the second position. The swellable element 110 can have a swell rate (i.e., volumetric increase per unit time) and a swell percentage (i.e., percent increase in volume of a given mass of elastomeric material) when at the first length 112 and a retarded or reduced swell rate and swell percentage when at the second length. For example, the swellable element 110 can have a swell percentage of about 1%, about 2%, about 4%, about 10%, about 100%, about 200%, about 300%, or more than about 300% when at the first length 112. The swell percentage of the swellable element 110 can be reduced by about 1%, about 10%, about 40%, about 60%, about 100%, about 300%, or more than 300% when at the second length.

Other proportions of reduction between the swell percentage of the swellable element 110 with the first length 112 and the swell percentage of the swellable element 110 with the second length are possible. Illustrative other proportions can include ranges from about 1% to about 50%, from about 40% to about 140%, from about 30% to about 180%, or from about 90% to about 390%. For example, the swellable element 110 having the first length 112 can swell from a first volume of two cubic feet to a second volume of four cubic feet when exposed to water.

When stretched to include the second length the swellable element 110 can have a retarded swell percentage when exposed to water, and the swellable element 110 at the second length can swell from a first volume of two cubic feet to a second volume of 3 cubic feet. The swell percentage of the swellable element 110 can be affected by the composition of the material of the swellable element 110, the amount of time that the swellable element 110 is exposed to a trigger, the quantity of the trigger the swellable element 110 is exposed to, the concentration of the trigger exposed to the swellable element 110, and any other variable that can affect a chemical reaction.

The swell rate of the swellable element 110 at the first length 112 can be about 1%, about 5%, about 10%, about 20%, about 50%, about 100%, about 200% or otherwise faster than the swell rate of the swellable element 110 at the second length. For example, the swell rate of the swellable element 110 at the first length 112 can be about 300 cubic feet per day, and the swell rate of the swellable element 110 at the second length can be about 100 cubic feet per day. Other swell rates and swell percentages are possible depending on the material of the swellable element 110. The swell percentage and swell rate of the swellable element 110 can be pre-selected for specific applications by the selection of a specific material.

The polymeric material or other material used to make the swellable element 110 can include material that will react with one or more triggers to volumetrically expand or otherwise swell. The trigger(s) can be one or more of the following: fluids, gas, temperature, pressure, pH, electric charge, and chemicals. Illustrative fluid triggers include water, hydrocarbons, treatment fluids, or any other fluid. Non-limiting examples of materials that can be used to make at least a portion of the swellable element 110 can include polyisoprene, polyisobutylene, polybutadiene, polystyrene, poly (styrene-butadiene), polychloroprene, polysiloxane, poly (ethylene-propylene), chorosulfonated polyethylene, and/or precursors, mixtures, or derivatives thereof.

The swellable element 110 can also include one or more materials having different reactivity to one or more downhole triggers. For example, the swellable element 110 can include one or more of polyacrylate, polyurethane and poly (acrylonitrile-butadiene), hydrogenated poly (acrylonitrile-butadiene), polyepichlorohydrin, polysulfide, fluorinated polymers, and/or precursors, mixtures, or derivatives thereof. In one or more embodiments, the swellable element 110 can be or include a fluorinated polymer and polyurethane.

In one or more embodiments, the swellable element 110 can include one or more polymeric materials, other materials, or a composite of materials that have a first swellable phase that volumetrically increases when exposed to water and/or aqueous solutions and a second swellable phase that volumetrically increases when exposed to hydrocarbons. In one or more embodiments, the swellable element 110 can include a polymeric material that has at least one first component that volumetrically changes and at least one second component that is relatively volumetrically inert or constant compared to the first component when the swellable element 110 is exposed to at least one trigger. For example, the swellable element 110 can include one or more swellable polymeric materials and one or more expandable mesh-linked structures.

The swellable element 110 can also include polymeric materials having a copolymer derived from at least one minimally reactive monomer forming at least a portion of a low-swelling phase and at least one highly reactive monomer forming at least a portion of a high-swelling phase. Accordingly, a portion of the swellable element 110 can have a lower swelling characteristic than another portion of the swellable element 110. The swellable element 110 can also be a composite that includes at least one copolymer having a swelling phase and a copolymer that does not swell when exposed to the trigger. The swellable element 110 can include materials that are mechanically mixed with one another. The swellable element 110 can also include one or more materials mixed with one another and chemically stabilized. For example, the materials can be stabilized by copolymerization and/or cross-linking. The swellable element 110 can include one or more swellable materials, that can be chemically bonded with one or more non-swelling materials and/or a different swellable material, through a compound having pendant unsaturated diene bonds.

The swellable element 110 can include one or more polymeric materials that are at least partially crosslinkable. For example, the polymeric material can be formulated to include one or more crosslinking agents or crosslinkers that affect the bulk characteristics of the material without inhibiting swelling kinetics. The swellable element 110 can also include one or more reinforcing agents that impart or improve the mechanical characteristics thereof. Illustrative reinforcing agents include calcium carbonate, clays, silica, talc, titanium dioxide, carbon black, glass microspheres, as well as organic and inorganic nanoscopic fillers.

In one or more embodiments, the rate at which the swellable element 110 reacts with the trigger can be increased by integrating or forming one or more transport paths (not shown) into the swellable element 110. Accordingly, the transport paths can increase the rate at which the triggers fully react with the swellable element 110. The transport paths can be formed by increasing the pore size and/or pore density of the material used to make the swellable element 110, integrating natural and synthetic cellulose-based substances with the material of the swellable element 110, integrating carbohydrates with the material of the swellable element 110, and/or integrating fabrics or textiles with the material of the swellable element 110.

The actuation device 140 can be any device that can be used to selectively move the second retainer 125 from the first position to the second position. The actuation device 140 can include a sliding sleeve, a piston arrangement, a rack and pinion system, a ratchet system, combinations thereof, or similar devices. The actuation device 140 can be configured to lock when the second retainer 125 is in the second position. For example, the actuation device 140 can be locked in place when the second retainer 125 is in the second position by one or more shear pins, one or more collets, or other releasable locking devices. The actuation device 140 can allow the second retainer 125 to return to the first position upon actuating the trigger mechanism 150. For example, the actuation device 140 can have stored potential energy, and the stored potential energy can urge or move the actuation device 140 and the second retainer 125 toward the first position of the second retainer 125. An exemplary embodiment of the actuation device 140 is discussed in more detail below in FIGS. 2A and 2B.

The trigger mechanism 150 can be any mechanism capable of releasing the actuation device 140, which may occur upon a predetermined event, time period, and/or controlled actuation. The trigger mechanism 150 can be an electrical trigger, a mechanical trigger, or the like. For example, the trigger mechanism 150 can include an electrical solenoid that can be actuated by a signal sent from the surface through a communication line and/or wireless telemetry. The solenoid can be configured to trip a latch when actuated, and the latch can release the actuation device 140 when tripped. Various exemplary embodiments of the trigger mechanisms 150 are described in more detail below in FIGS. 3-6.

Figure 2A:
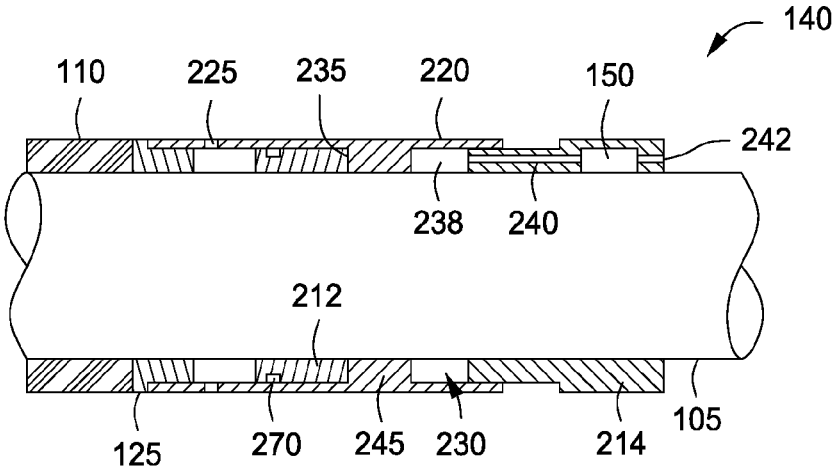
FIG. 2A depicts an enlarged cross-sectional view taken from FIG. 1 of an exemplary actuation device and trigger mechanism, wherein the actuation device is in a first position, according to one or more embodiments described.

FIG. 2A depicts a cross-sectional view of the actuation device 140 and trigger mechanism 150, according to one or more embodiments. In FIG. 2A, the second retainer 125 is shown in the first position, which leaves the swellable material 110 substantially un-strained. The actuation device 140 can include a body, which may be segmented into first and second body sections 212, 214. The actuation device 140 can also include a housing 220, which may also be referred to as a piston 220, and channels or flow paths, for example, actuation flow paths 240, 242, which can be formed through the body 214.

The actuation device 140 can be disposed on, for example, circumferentially around, at least a portion of the tubular member 105. The first and second body sections 212, 214 can be spaced axially apart to define a chamber 230 therebetween. The housing 220 can have an inner diameter, and a ring or shoulder 245 formed into or disposed on the inner diameter thereof. The ring 245 can be slidably received into the chamber 230 between the first and second body sections 212, 214, thereby segmenting the chamber 230 into first and second chamber sections 235, 238 between the first and second body sections 212, 214. The ring 245 can move between the first body section 212 and the second body section 214, wherein the volume of the first chamber section 235 increases in volume as the housing 220 slides toward the second body section 214, and the volume of the second chamber section 238 increases as the housing 220 moves toward the first body section 212. In an exemplary embodiment, when the second retainer 125 is in the first position, as shown, the ring 245 can be adjacent to and/or engage the first body section 212, such that the first chamber section 235 has substantially no volume.

The second body section 214 can have the first and second actuation flow paths 240, 242 formed therethrough. The first actuation flow path 240, which can also be referred to as the upper actuation flow path 240, can be in fluid communication with the second chamber section 238. The lower or second actuation flow path 242 can be in fluid communication with a wellbore, downhole, or external or other ambient environment. Furthermore, the first and second actuation flow paths 240, 242 can be in selective fluid communication with one another, via the trigger mechanism 150. As used herein, "selective fluid communication" is generally defined to mean that fluid is allowed to pass through the various flow paths described herein when desired, and also blocked, obstructed, or otherwise disallowed when desired. For example, fluid communication between the first and second actuation flow paths 240, 242 can be selectively provided to communicate the first chamber section 238 with a wellbore, downhole, or other external or other ambient environment.

Figure 2B:
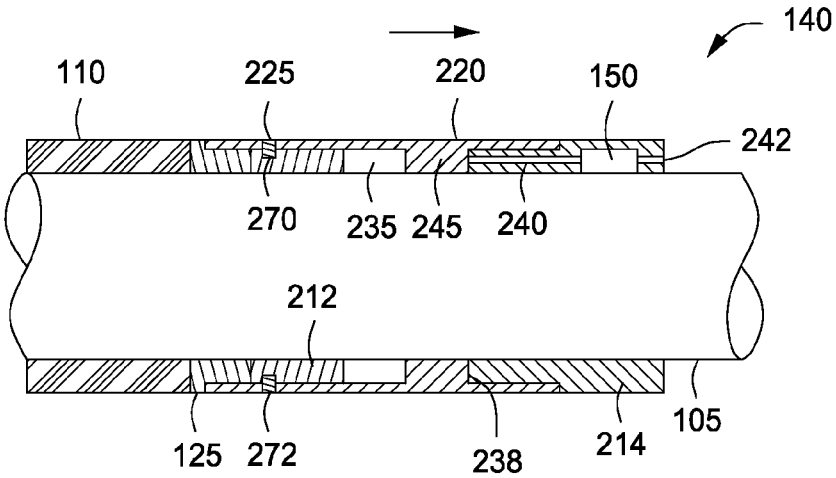
FIG. 2B depicts an enlarged cross-sectional view of the actuation device shown in FIG. 2A, in a second position.

FIG. 2B, with continuing reference to FIG. 2A, depicts an exemplary actuation device 140, with the second retainer 125 in the second position. The housing 220 can slide (toward the right from FIG. 2A to FIG. 2B) such that the ring 245 can engage the second body section 214. Accordingly, the volume of the second chamber section 235 can increase, while the volume of the first chamber section 238 can decrease to, for example, substantially nothing, thereby allowing the ring 245 to be adjacent to and/or engage the second body section 214. Since the housing 220 can be connected to the second retainer 125, the second retainer 125 can be moved by the moving of the housing 220 (e.g., to the right, as shown). Furthermore, the second retainer 125 can be connected to the swellable material 110, as discussed above. As also noted above, the swellable material 110 can be connected to the first retainer 120 (FIG. 1), which can remain stationary relative to the second retainer 125. Thus, the swellable material 110 can be stretched or strained axially as the second retainer 125 slides away from the first retainer 120 toward the second position, as described in further detail below with reference to FIGS. 7 and 8.

The housing 220 can maintain the second retainer 125 in the second position by connecting the housing 220 to the first body section 212 with, for example, a shear pin 272. It will be appreciated that other releasable attachment devices, which may also be referred to herein as piston locks, can connect the housing 220 with the first body section 212 may be employed without departing from the scope of this disclosure. Additional exemplary attachment devices can include shear screws, shear wires, collets, shear rings, brittle welds or solders, and the like. In the illustrated exemplary embodiment, to receive the shear pin, the housing 220 can include a hole 225, and the first body section 212 can include a notch 270, both of which may be threaded, if appropriate to receive the shear pin 272. To release the strain on the swellable material 110, the second retaining member 125 can be released from the second position, for example, by actuating or triggering the trigger mechanism 150.

Figure 3:
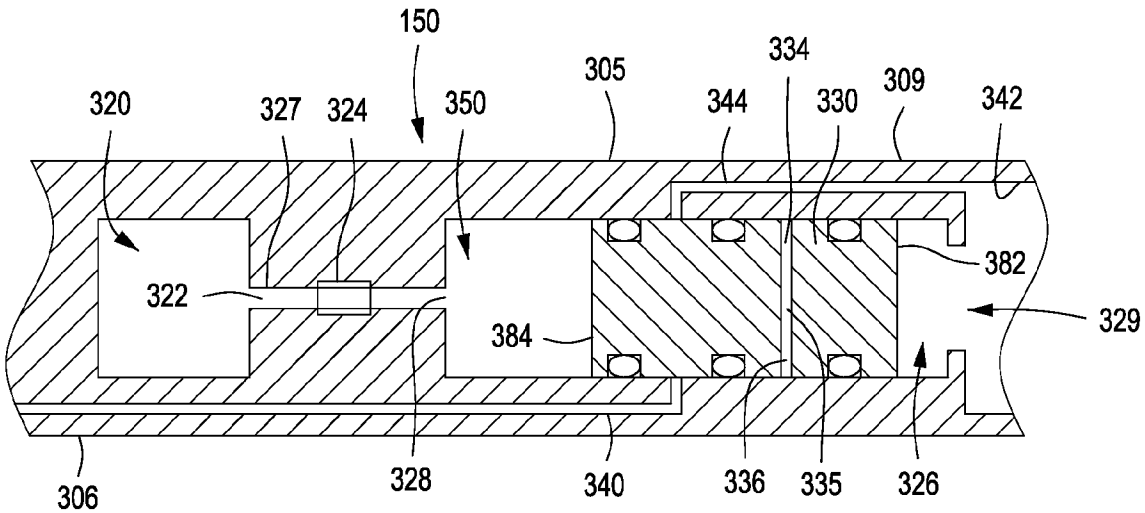
FIG. 3 depicts a cross-sectional view of an exemplary trigger mechanism in a first position, according to one or more embodiments described.

FIG. 3 depicts a cross-sectional view of an exemplary trigger mechanism 150 in a first position. With continuing reference to FIGS. 1-2B, the trigger mechanism 150 can be or include a hydraulic metering device with a pre-determined duration of activation. The trigger mechanism 150 can include a body 305, first and second hydraulic chambers 320, 326 formed through the body 305, a flow control device 324 disposed between the first and second hydraulic chambers 320, 326, a cylinder or spool 330 at least partially disposed in the second hydraulic chamber 326, and separating the second hydraulic chamber 326 into first and second chamber sections 329 and 350.

The first hydraulic chamber 320 can be formed into an upper or first portion 306 of the body 305. The first hydraulic chamber 320 can have a square, triangular, circular, or any other shaped cross section. The first hydraulic chamber 320 can have any volume. For example, the first hydraulic chamber 320 can have a volume of about 1 cubic foot, about 2 cubic feet, about 3 cubic feet, about 5 cubic feet, or more. The first hydraulic chamber 320 can have an inlet 322 in fluid communication with an outlet 328 of the second hydraulic chamber 326 via flow path 327.

The flow path 327 can be a conduit connected to the inlet 322 and the outlet 328 or a channel formed through the body 305 between the inlet 322 and the outlet 328. The flow control device 324 can be connected with the flow path 327, and can be interposed therein, between the first and second hydraulic chambers 320, 326. In one or more embodiments, the flow control device 324 can be disposed between two portions of the flow path 327 and can couple the two portions of the flow path 327 together. The flow control device 324 can be an orifice, a fixed choke, or other device capable of controlling the flow rate through the flow path 327.

The second hydraulic chamber 326 can be formed into a lower or second portion 309 of the body 305. The second hydraulic chamber 326 can have a square, triangular, circular, or other cross-sectional shape. The second hydraulic chamber 326 can have any volume. For example, the second hydraulic chamber 326 can have a volume of about 1 cubic foot, about 2 cubic feet, about 3 cubic feet, about 5 cubic feet, or more. The first chamber section 329 of the second hydraulic chamber 326 can also be referred to herein as inlet 329, and can be in fluid communication with an upper or second flow path 342. The second flow path 342 can be in fluid communication with the second actuation flow path 242 (FIGS. 2A and 2B) and/or with the downhole environment.

The spool 330 can be movably disposed within the second hydraulic chamber 326 between the first chamber section 329 and the second chamber section 350. The second chamber section 350 can be at least partially filled with hydraulic fluid. The spool 330 can have a cylindrical, square, or other elongated cross-sectional shape. The spool 330 can move from a first position within the second hydraulic chamber 326 to a second position within the second hydraulic chamber 326, thereby forcing hydraulic fluid from the second chamber section 350 of the second hydraulic chamber 326 to the first hydraulic chamber 320. The spool 330 can have a lower or second end 382 and an upper or first end 384. The second end 382 can be in fluid communication with the second flow path 342. The first end 384 can be adjacent the second chamber section 350.

The spool 330 can have a spool channel 335 formed through a portion thereof and configured to selectively allow fluid communication through the trigger mechanism 150. The spool channel 335 can have a first end 334 and a second end 336. The second end 336 can be configured to align with a first trigger flow path 340 formed at least partially into the body 305 of the trigger mechanism 150, and the first end 334 can be configured to align with an a second trigger flow path 344 formed into the body 305 of the trigger mechanism 150, wherein the second trigger flow path 344 can be in fluid communication with the second actuation flow path 342.

The first trigger flow path 344 can be a conduit disposed within a portion of the body 305 or a channel formed into the body 305. The first trigger flow path 344 can have a flow area of about 1 square inch, about 2 square inches, about 3 square inches, about 4 square inches, about 20 square inches, or more. The first trigger flow path 340 can be formed into the first portion 306 of the body 305, and can be a conduit disposed within or a channel formed into the body 305. The first trigger flow path 340 can be in fluid communication or integral with one or more upper flow paths formed into the actuation device 140. All of the flow paths herein described may have a flow area or flow area range of from a lower end of about 1, 2, 4, 5, 7, 10, 12, 15, or 20 square inch(s) to an upper end of about 22, 24, 25, 27, 30, 32, 35, 37 or 40 square inches In exemplary operation, the spool 330 can be initially located in the first position within the second hydraulic chamber 326, a solid portion of the spool 330 can be aligned with the first and second trigger flow paths 344, 340, and the ends 334, 336 of the spool channel 335 can be aligned with solid portions of the body 305. Pressure from the second flow path 342 can act upon the second end 382 of the spool 330 and urge or move the spool 330 to the second position within the second hydraulic chamber 326, thereby decreasing the volume of the second chamber section 350.

Figure 4:
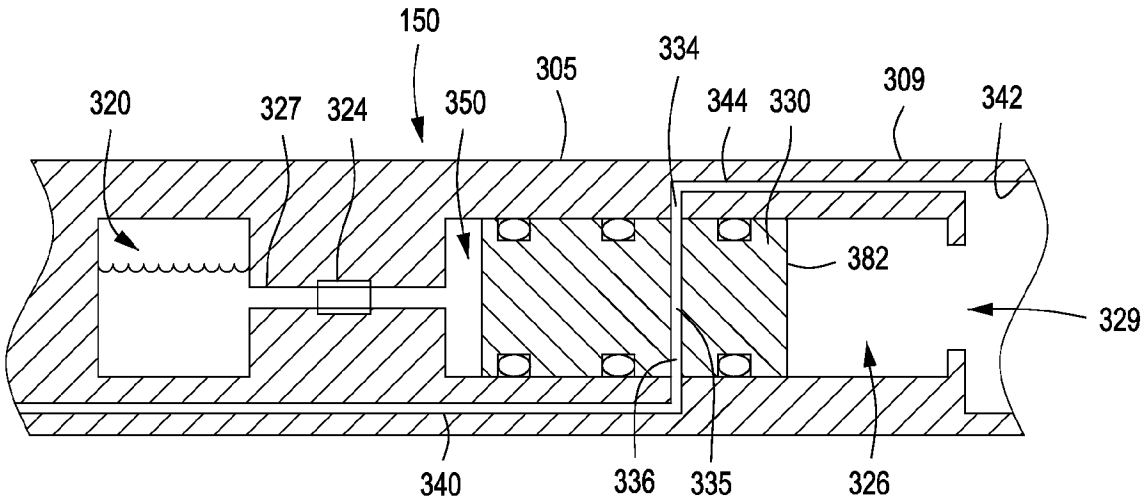
FIG. 4 depicts a cross section view of the trigger mechanism shown in FIG. 3 in a second position, according to one or more embodiments described.

FIG. 4 depicts a cross section view of the trigger mechanism 150 of FIG. 3 with the spool 330 in the second position within the second hydraulic chamber 326, according to one or more embodiments. Referring additionally to FIGS. 1-2B, pressure can be exerted on the second end 382 of the spool 330 by the wellbore environment via fluid communication through the second actuation flow path 242 and the second flow path 342. This can move the first end 384 of the spool 330, forcing hydraulic fluid from the second chamber section 350 of the second hydraulic chamber 326 to the first hydraulic chamber 320. The rate at which hydraulic fluid flows from the second chamber section 350 to the first hydraulic chamber 320 can be pre-determined by the flow characteristics of the flow control device 324. For example, if a large flow rate is desired, the flow control device 324 can have a large flow area, but if a smaller flow rate is desired, the flow control device 324 can have a smaller flow area. Eventually, the hydraulic fluid can vacate the second chamber section 350 of the second hydraulic chamber 326, and the spool 330 can move to the second position within the second hydraulic chamber 326. When the spool 330 is in the second position within the second hydraulic chamber 326, the first trigger flow path 340 is in fluid communication with flow paths 342, 344 via the spool channel 335. Accordingly, the pressure within the flow path 342 can activate the actuation device 140. It will be appreciated that the spool 330 can move in other manners, for example rotating in addition to or instead of sliding, in the second hydraulic chamber 326 without departing from the scope of this disclosure.

Figure 5:
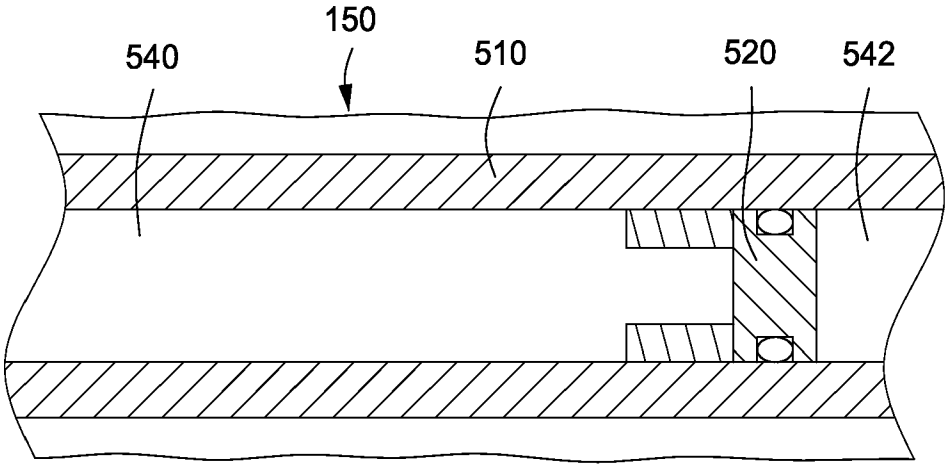
FIG. 5 depicts a cross-sectional view of another exemplary embodiment of the trigger mechanism, according to one or more embodiments described.

FIG. 5 depicts a cross-sectional view of another exemplary trigger mechanism 150. With continuing reference to FIG. 1, the trigger mechanism 150 can have first and second trigger flow paths 540, 542 formed through a body 510, and a dissolvable plug 520 can be disposed between the first and second trigger flow paths 540, 542. The first trigger flow path 540 can be a conduit disposed within or a channel formed into the body 510. The first trigger flow path 540 can be in fluid communication or integral with the first actuation flow path 240 formed into the actuation device 140 (shown in FIGS. 2A and 2B). The second trigger flow path 542 can be a conduit disposed within or a channel formed into the body 510. The second flow path 542 can be in fluid communication or integral with the second actuation flow path 242 (shown in FIG. 2A) and/or the environment external of the actuation device 140.

The dissolvable plug 520 can be made from any material that breaks down or dissolves when exposed to one or more fluids, such as hydrocarbons or water. The dissolvable plug 520 can be or include inorganic fibers, for example, of limestone or glass, polymers or co-polymers of esters, amides, or other similar materials. Illustrative materials include polyhydroxyalkanoates, polyamides, polycaprolactones, polyhydroxybutyrates, polyethyleneterephthalates, polyvinyl alcohols, polyvinyl acetate, partially hydrolyzed polyvinyl acetate, and copolymers of these materials. Polymers or copolymers of esters, for example, include substituted and unsubstituted lactide, glycolide, polylactic acid, and polyglycolic acid. Polymers or co-polymers of amides, for example, may include polyacrylamides.

In exemplary operation, fluid within the second trigger flow path 542, such as wellbore fluid, can at least partially dissolve the dissolvable plug 520. The dissolvable plug 520 can fail or break after being exposed to the fluid for a period of time, and the first and second trigger flow paths 540, 542 can be placed in fluid communication. Accordingly, when the dissolvable plug 520 fails, pressure from the first and second trigger flow paths 540, 542 can allow fluid flow through the trigger mechanism 150, thereby activating the actuation device 140. For example, the second trigger flow path 542 can be in fluid communication with a wellbore, and pressure within the wellbore can be used to actuate the actuation device 140.

Figure 6:
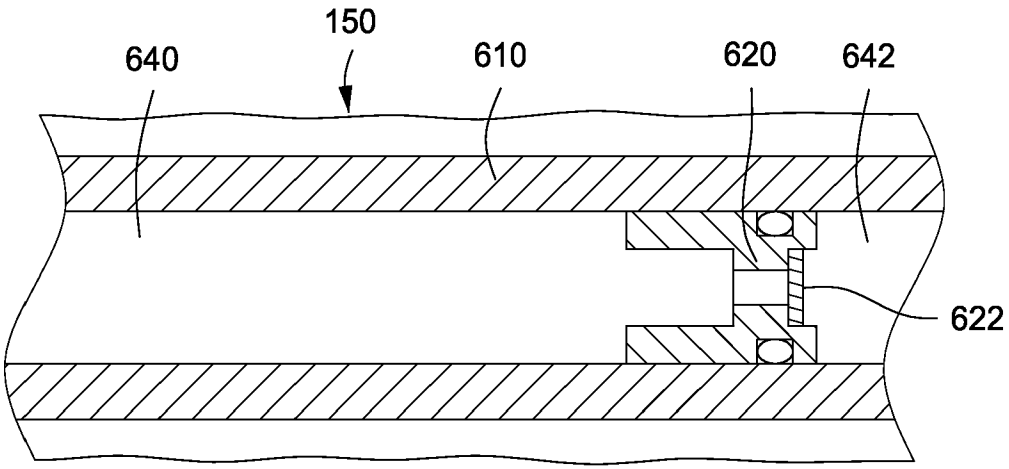
FIG. 6 depicts a cross-sectional view of yet another exemplary embodiment of the trigger mechanism, according to one or more embodiments described.

FIG. 6 depicts a cross-sectional view of yet another exemplary trigger mechanism 150. With continuing referring to FIG. 1, the trigger mechanism 150 can have the first and second trigger flow paths 640, 642 at least partially disposed in or formed though the trigger mechanism body 610. A rupture disk 622 can be disposed between the flow paths 640, 642, supported by disk support member 620.

The rupture disk 622 can be designed to burst at a predetermined pressure. For example, the rupture disk 622 can bust at a pressure of about 10 psi, about 20 psi, about 30 psi, about 40 psi, or more. Fluid communication between the first and second trigger flow paths 540, 542 is established when the rupture disk 622 bursts. Pressure from the flow path 642 can be used to actuate the actuation device 140 when the first and second trigger flow paths 640, 642 are in fluid communication.

Figure 7:
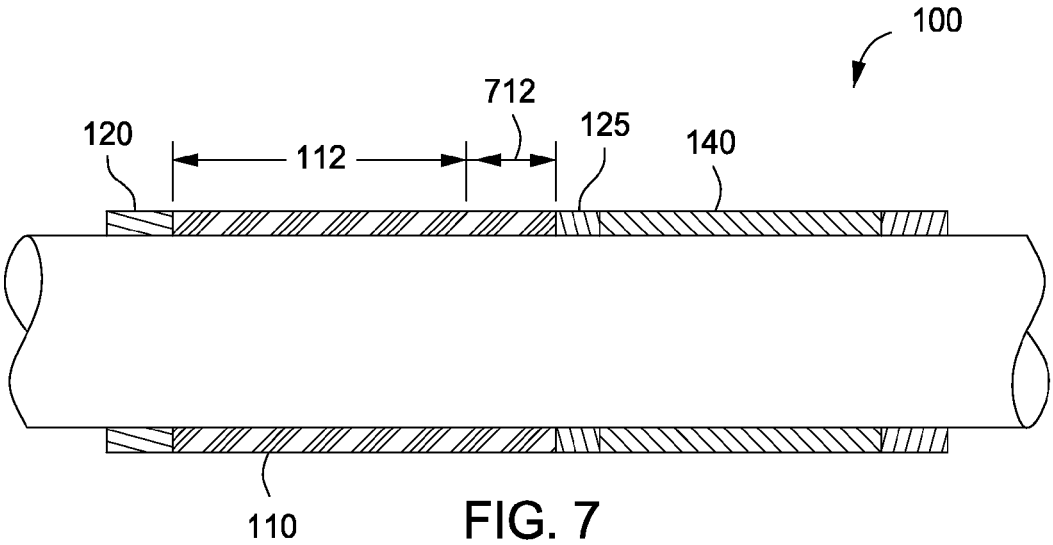
FIG. 7 depicts a cross-sectional view of an exemplary swellable packer with the second retainer in the second position, according to one or more embodiments described.

FIG. 7 depicts a cross-sectional view of the exemplary swellable packer 100 of FIG. 1 with the second retainer 125 in the second position, according to one or more embodiments. The second retainer 125 can be moved to the second position by moving the housing 220, as discussed above with reference to FIGS. 2A and 2B, and can be done so prior to conveying the swellable packer 100 downhole. The swellable element 110 can thus be stretched a distance 712 from the first length 112 by moving the second retainer 125 to the second position, as the first retainer 120 can remain stationary. In other exemplary embodiments, the first retainer 120 can move in a direction opposite the movement of the second retainer 125, to compound the stretching of the swellable element 110. The additional distance 712 can be less than about 1 inch, about 1 inch, about 2 inches, about 3 inches, about 10 inches, about 20 inches, about 24 inches, or more. Alternatively, the additional distance 712 may be less than about 1, about 5, about 15, about 25, about 35, about 50, about 75, about 100, about 125, about 150, about 175, about 200 or more percent greater than the first length 112.

The second retainer 125 can be locked in the second position by the actuation device 140, as described above with reference to FIG. 2B, and the swellable packer 100 can be conveyed downhole with the swellable element 110 in a strained condition, as depicted in and described below with reference to FIG. 8.

Figure 8:
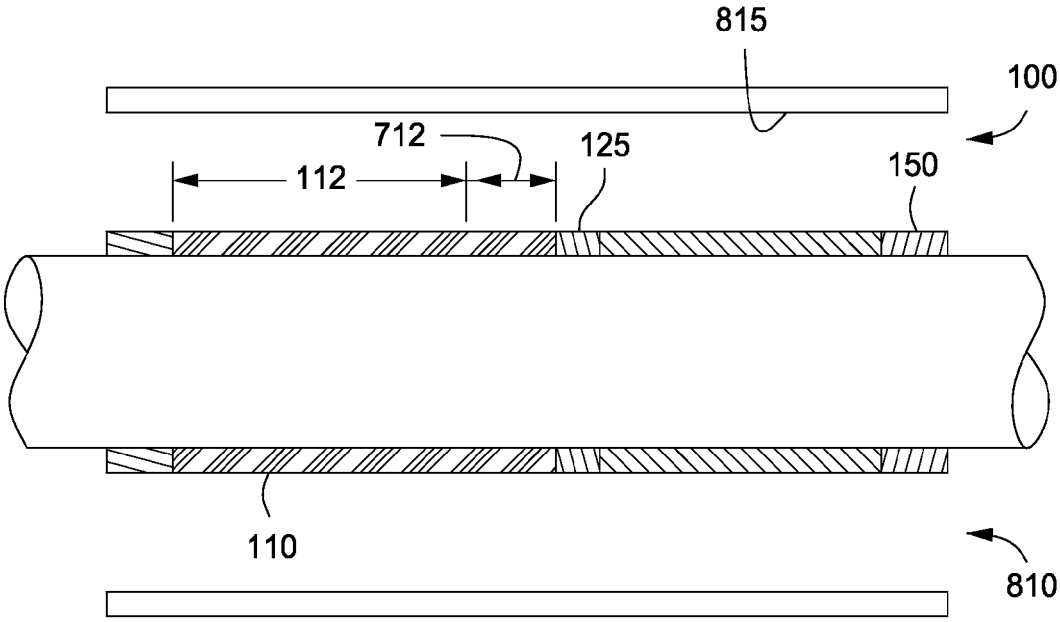
FIG. 8 depicts a cross-sectional view of an exemplary swellable packer disposed within a wellbore, according to one or more embodiments described.

FIG. 8 depicts a cross-sectional view of the swellable packer 100 disposed within a wellbore 810, according to one or more embodiments. The swellable packer 100 can be conveyed into the wellbore 810 with the second retainer 125 in the second position and the swellable element 110 held thereby in a strained condition (i.e., with a length equal to the first length 112 plus the stretched amount 712). As a result of the pre-straining placed on it, the swellable element 110 can have a retarded swell percentage and/or swell rate, as the amount and rate at which wellbore fluid is absorbed is reduced by the straining, as described below with reference to FIG. 10. Accordingly, the swellable packer 100 can be conveyed to a desired location within the wellbore 810, and the swellable element 110 can avoid prematurely catching on or securing to walls 815 of the wellbore 810. Once the swellable packer is deployed to the desired location, the second retainer 125 can be released from the second position by actuating or triggering the trigger mechanism 150, as described below with reference to FIG. 9.

Figure 9:
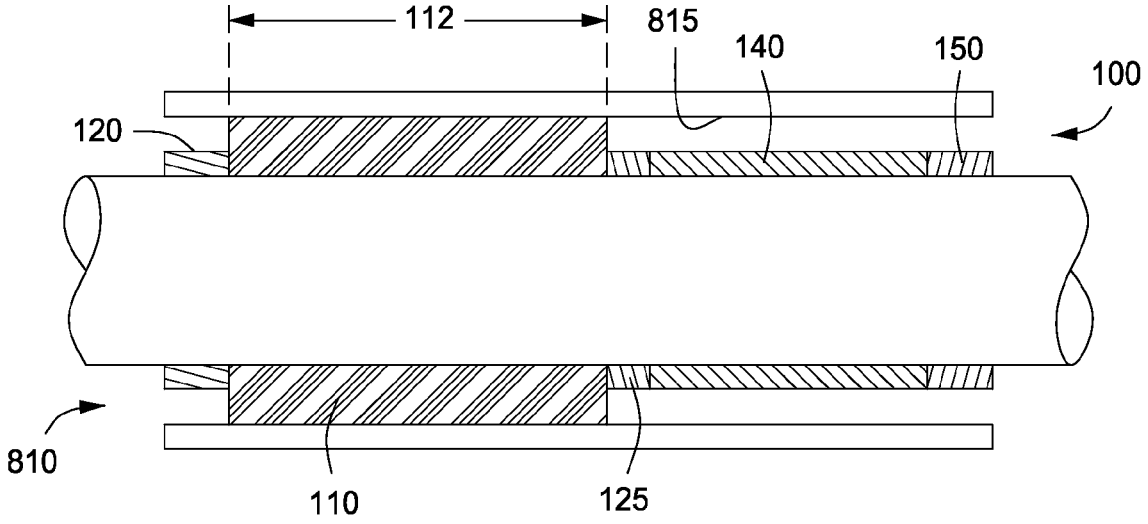
FIG. 9 depicts a cross-sectional view of an exemplary swellable packer secured within the wellbore, according to one or more embodiments described.

FIG. 9 depicts a cross-sectional view of the swellable packer 100 secured within the wellbore 810, according to one or more embodiments. Upon locating the swellable packer 100 in the wellbore 810, the trigger mechanism 150 can be triggered to activate the actuation device 140. As described above, triggering or actuating the trigger mechanism 150 (described in detail above with reference to FIGS. 3-6) fluidly connects the first and second actuation flow passages 240, 242 (FIGS. 2A and 2B), thereby applying a pressure therethrough on the actuation device 140. The pressure pushes the actuation device 140 and therefore the second retainer 125 toward the first retainer 120, breaking, removing, or otherwise withdrawing the influence of any fastening devices that initially held the second retainer 125 in the second position, thereby relieving the strain on the swellable element 110.

The second retainer 125 thus returns to the first position when the actuation device 140 is activated, reducing the length of the swellable element by the length 712 (FIG. 8), returning the swellable element to the first length 112. Accordingly, at this position the swellable element 110 is in an un-strained or original condition or length. The swellable element 110 having the first length 112 swells at its full swell rate to its full swell, by absorbing, or otherwise reacting to, fluid in the wellbore. Accordingly, the swellable element 110 can engage the walls 815 of the wellbore 810 and secure the swellable packer 100 within the wellbore 810.

Figure 10:
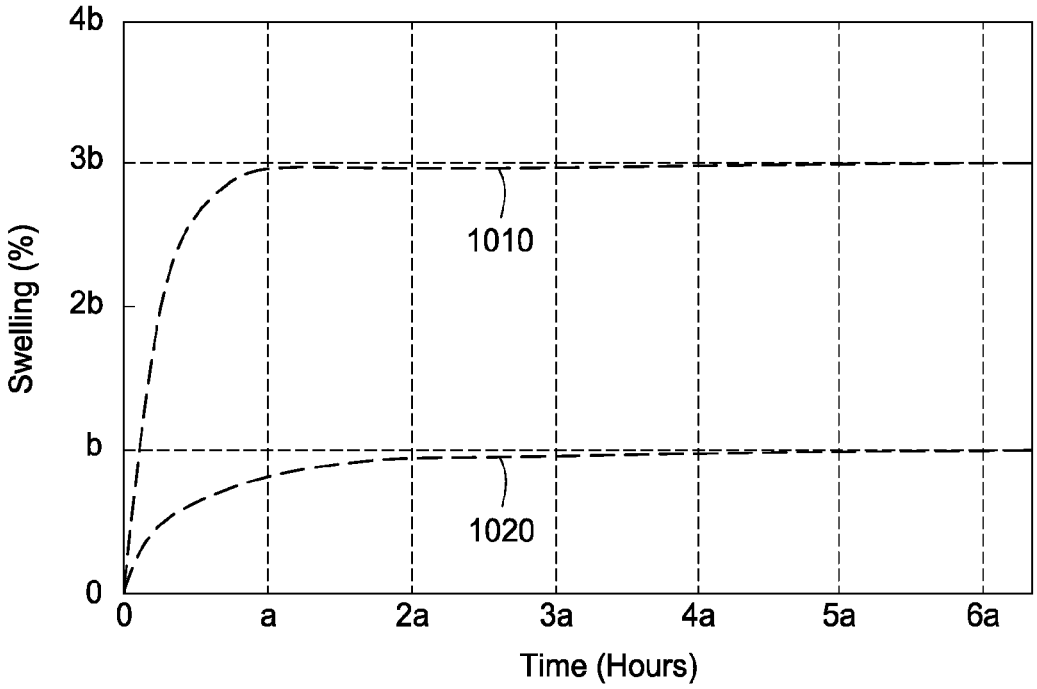
FIG. 10 depicts an exemplary graphical representation of the swelling percentage as a function of time for a swellable element in an un-strained condition and in a strained condition, according to one or more embodiments described.

FIG. 10 depicts a plot of the swelling percentage as a function of time for a swellable element in an un-strained condition and in a strained condition, according to one or more embodiments. The un-strained swellable element function, which is represented by the line 1010, substantially reaches the maximum swelling percentage "3b" at time "a." Whereas, if the same swellable element is strained, whose swell function is represented by line 1020, the strained swellable element substantially reaches a swell percentage of "b" after a time lapse of "6a." Accordingly, the maximum swell percentage of the strained swellable element can be less than the maximum swell percentage of the un-strained swellable element by a factor of three. The ratio of the maximum swell percentage of the strained swellable element to the maximum swell percentage of the un-strained swellable element can be from about 1:2, 1:3, 1:5, 1:6, 1:7, 1:10, or 1:100. Other ratios of the maximum swell percentage of the strained swellable element and the maximum swell percentage of the un-strained swellable element are possible. In addition, the time it takes for the strained swellable element to reach its maximum swell percentage is greater than the time it takes for the un-strained swellable element to reach its maximum swell percentage. As such, the straining of the swellable element unexpectedly retards the maximum swell percentage of the swellable element and the swell rate. Retarding the maximum swell percentage and/or swell rate can include reducing the maximum swell percentage or swell rate of the swellable element or both by at least one percent.

Figure 11:
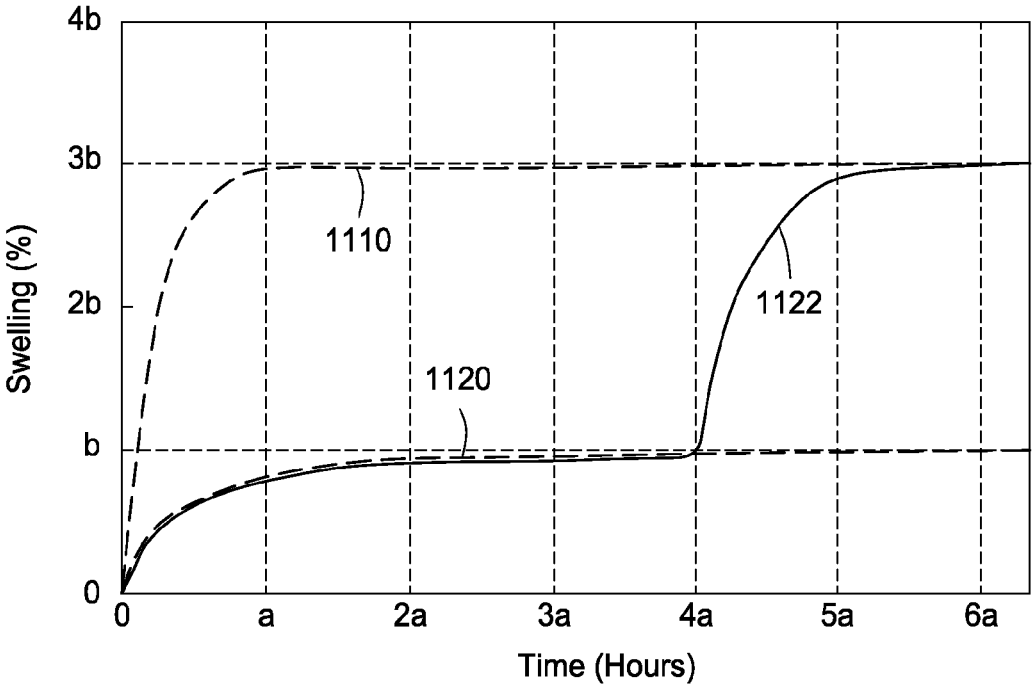
FIG. 11 depicts an exemplary graph of the swelling percentage as a function of time for a swellable element that is initially in a strained condition and is placed in an un-strained condition after a predetermined time period, according to one or more embodiments described.
Figure 12:
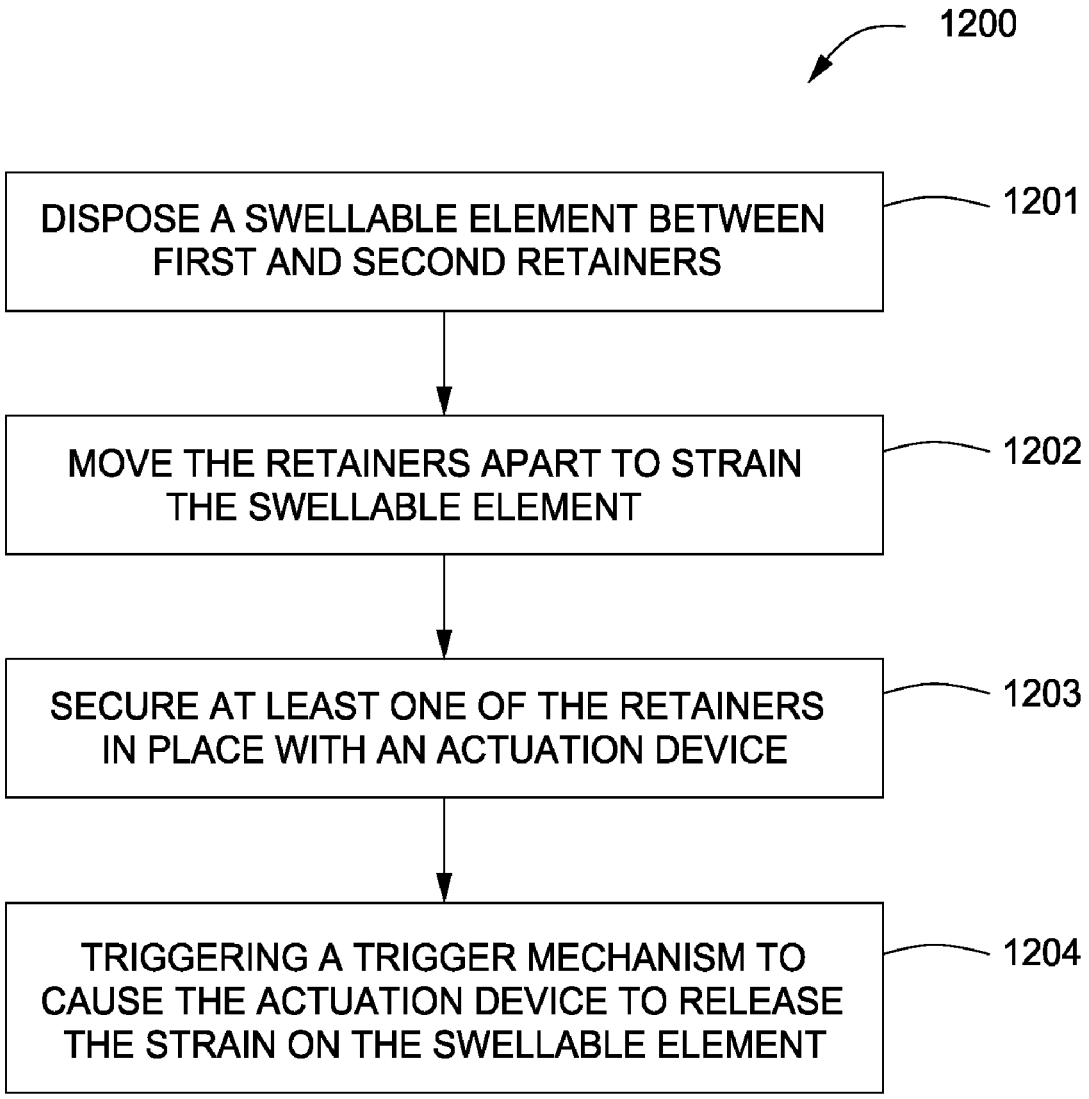
FIG. 12 depicts a flow chart of an exemplary method of controlling the swell rate of a swellable element, according to one or more embodiments described.

FIG. 11 depicts the swelling percentage as a function of time for a swellable element that is initially in a strained condition and is placed in an un-strained condition after a predetermined time period of "4a," according to one or more embodiments. The swellable element in an unstrained condition function, represented by line 1110, substantially increases to a swelling percentage of "3b" in a time period from 0 to "a." In contrast, the swellable element in a strained condition function, represented by line 1120, approaches a swelling percentage of "b" in a time period from 0 to "4a." As represented by line 1120, the swell percentage of strained swellable element approaches "b" and plateaus. Accordingly, when the swellable element is in a strained condition the swelling percentage of the swellable element is limited to a swelling percentage of "b." However, when the swellable element is placed in an un-strained condition after time "4a," which is represented by line 1122, the swelling percentage of "3b" is achieved after a time lapse of about "2A." Accordingly, by selectively straining the swellable element for a pre-determined time and releasing the strain force after the pre-determined time, the swelling rate of the swellable element can be controlled and at the same time a full swell percentage can be achieved.

With additional reference to FIGS. 1-2B, FIG. 12 depicts a flow chart of an exemplary embodiment of a method 1200 of controlling the swell rate of a swellable element 110. The method 1200 may include disposing a swellable element 110 between first and second axially spaced apart retainers 120, 125, as at 1201. The swellable element 110 may be fixedly attached to the retainers 120, 125, so that movement of the retainers 120, 125 can stretch or compress the swellable element. Furthermore, as described above with reference to FIGS. 1, 10, and 11, the swellable element 110 may have a full swell rate and expansion ratio when in an unstrained state or condition, and a reduced swell rate and expansion ratio when in a strained state or condition.

In one or more exemplary embodiments, the method 1200 may include moving the first and second retainers 120, 125 apart to strain the swellable element 110, as at 1202. This may be a pre-straining operation, for example, prior to deploying the swellable element into a wellbore. Moving the retainers 120, 125 apart can include moving the second retainer 125 from a first position to a second position away from the first position and/or the first retainer 120; further, in various exemplary embodiments, both the first and second retainers 120, 125 may be moved relative to one another. Such movement can increase the axial separation of the first and second retainers 120, 125, thereby stretching or straining the swellable element 110.

The position of the retainers 120, 125 relative to one another can be secured by the actuation device 140, as at 1203, to maintain the strain on the swellable element 110 for any desired period of time. For example the second retainer 125 can be secured in the second position with the actuation device 140, while the first retainer 120 may be stationarily fixed to the tubular body 105. The actuation device 140 may be substantially the same as that described above with reference to FIGS. 2A and 2B.

To release the strain on the swellable element 110, the method 1200 may include triggering or actuating the trigger mechanism 150 to cause the actuation device 140 to release at least one of the retainers 120 and/or 125, as at 1204. This may be accomplished by any of the trigger mechanisms 150 described above with reference to FIGS. 3-6, or by other trigger mechanisms. For example, actuating the trigger mechanism 150 can include dissolving a plug 520 (FIG. 5) or breaking a rupture disk 622 (FIG. 6). In other examples, the triggering or actuating the trigger mechanism 150 can include controlling a rate of fluid migration from a first to second hydraulic chamber 320, 350 (FIG. 3) in response to a pressure applied by, for example, a downhole environment.

Certain embodiments and features have been described using a set of numerical upper limits and a set of numerical lower limits It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

As used herein, the terms "up" and "down;" "upper" and "lower;" "upwardly" and "downwardly;" "upstream" and "downstream;" and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method of controlling a swell rate of a swellable element, comprising:

stretching the swellable element disposed on a tubular member attached between a first retainer and a second retainer by moving the second retainer from a first position to a second position away from the first position, said stretching to retard swell;

securing the second retainer in the second position with an actuation device; and actuating a trigger mechanism to cause the actuation device to release the second retainer from the second position to move toward the first retainer, said actuating comprising:

forcing a hydraulic fluid through a flow control device to move a spool from a first position where a flow path between a chamber defined in the actuating mechanism and a downhole environment is obstructed to a second position where the flow path is at least partially unobstructed to allow a fluid flow therethrough; and moving a piston with a pressure applied by the fluid flow to release the second retainer from the second position.

2. A swellable packer, comprising:

a tubular member;

a first retainer fixed to the tubular member;

a second retainer disposed on the tubular member, spaced axially apart from the first retainer, and axially movable between a first position and a second position;

a swellable element disposed on the tubular member between and attached to the first retainer and the second retainer;

an actuation device connected to the second retainer and configured to releasably secure the second retainer in the second position; to retard swell of said swellable element, said actuation device comprising:

an actuation body disposed on the tubular member and comprising first and second actuation body sections spaced axially apart to define a chamber therebetween;

a housing movably disposed around the actuation body; and a ring connected to an inner diameter of the housing and slidably disposed in the chamber, wherein the ring separates the chamber into a first chamber section and a second chamber section; and a trigger mechanism connected to the actuation device and configured to release the second retainer from the second position when the trigger mechanism is triggered.

3. The swellable packer of claim 2, further comprising:

first and second actuation flow paths defined in the second actuation body section, wherein the first actuation flow path communicates with a wellbore environment and the second actuation flow path communicates with the chamber, wherein the first actuation flow path communicates with the second chamber section, and the second actuation flow path communicates with a wellbore environment, and wherein the trigger mechanism is disposed between the first and second actuation flow paths, and is configured to provide selective fluid communication between the first and second actuation flow paths.

4. The swellable packer of claim 3, wherein the trigger mechanism comprises:

a trigger body having a trigger flow path defined therein, wherein the trigger flow path fluidly communicates with the first actuation flow path, and the second actuation flow path;

a hydraulic chamber defined in the trigger body; and a spool movably disposed in the hydraulic chamber and configured to move between a first position and a second position, the spool configured to block a flow through the trigger flow path when the spool is in the first position and allow the flow through the trigger flow path when the spool is in the second position.

5. The swellable packer of claim 4, wherein the trigger flow path comprises:

a first trigger flow path in fluid communication with the first actuation flow path; and a second trigger flow path in fluid communication with the second actuation flow path; and the spool comprises a channel defined therein, the channel connecting the first and second trigger flow path sections when the spool is in the second position.

6. The swellable packer of claim 3, wherein the trigger mechanism comprises a dissolvable plug disposed between the first and second actuation flow paths.

7. The swellable packer of claim 3, wherein the trigger mechanism comprises a rupture disk disposed between the first and second actuation flow paths.

8. A swellable packer, comprising:

a first retainer;

a second retainer spaced axially apart from the first retainer;

a swellable element at least partially disposed between the first and second retainers and fixed to the first and second retainers;

a piston fixed to the second retainer and configured to move the second retainer from a first position in which the swellable element is unstrained, to a second position in which the swellable element is strained; and a piston lock configured to releasably fix the second retainer in the second position.

9. The swellable packer of claim 8, further comprising a first body section and a second body sections, wherein the first and second body sections are spaced axially apart to define a chamber therebetween, wherein the piston further comprises a ring slidably received into the chamber.

10. The swellable packer of claim 9, further comprising an actuation flow path fluidly communicating with the chamber and a downhole environment.

11. The swellable packer of claim 10, further comprising a trigger mechanism disposed in the actuation flow path, to provide selective fluid communication through the actuation flow path.

12. The swellable packer of claim 11, wherein the trigger mechanism is configured to block the actuation flow path until triggered and allow a flow of fluid through the actuation flow path and into the chamber after the trigger mechanism is triggered.

13. The swellable packer of claim 12, wherein the trigger mechanism comprises:

a first hydraulic chamber;

a second hydraulic chamber including a hydraulic fluid and in fluid communication with the first hydraulic chamber;

a spool disposed in the second hydraulic chamber, slidable between a first position and a second position, and having a spool channel defined therein, wherein the spool sliding from the first to the second position forces fluid from the second hydraulic chamber to the first hydraulic chamber; and a flow control device configured to regulate a flow rate of the hydraulic fluid from the second hydraulic chamber to the first hydraulic chamber, wherein the spool in the first position obstructs the actuation flow path, and the spool in the second position allows a flow of fluid through the actuation flow path.

14. The swellable packer of claim 11, wherein the trigger mechanism comprises a dissolvable plug configured to temporarily obstruct the actuation flow path.

15. The swellable packer of claim 11, wherein the trigger mechanism comprises a frangible disk configured to breakably obstruct the actuation flow path.

* * * * *